US008613311B2

(12) United States Patent
Xiao et al.

(10) Patent No.: US 8,613,311 B2
(45) Date of Patent: Dec. 24, 2013

(54) APPARATUS AND METHODS FOR WELL COMPLETION DESIGN TO AVOID EROSION AND HIGH FRICTION LOSS FOR POWER CABLE DEPLOYED ELECTRIC SUBMERSIBLE PUMP SYSTEMS

(75) Inventors: Jinjiang Xiao, Dhahran (SA); Mohamed Nabil Noui-Mehidi, Dhahran (SA); Ahmed Yasin Bukhamseen, Dammam (SA)

(73) Assignee: Saudi Arabian Oil Company (SA)

( * ) Notice: Subject to any disclaimer, the term of this patent is extended or adjusted under 35 U.S.C. 154(b) by 337 days.

(21) Appl. No.: 13/031,240

(22) Filed: Feb. 20, 2011

(65) Prior Publication Data

US 2012/0211240 A1 Aug. 23, 2012

(51) Int. Cl.
*E21B 43/00* (2006.01)

(52) U.S. Cl.
USPC ..... 166/105; 166/372

(58) Field of Classification Search
USPC ..... 166/105, 106, 369, 372; 310/54, 60 A, 310/87
See application file for complete search history.

(56) References Cited

U.S. PATENT DOCUMENTS

| | | | | |
|---|---|---|---|---|
| 3,642,070 | A * | 2/1972 | Taylor et al. | 166/372 |
| 3,670,832 | A | 6/1972 | Striegler | |
| 4,440,221 | A * | 4/1984 | Taylor et al. | 166/106 |
| 4,901,069 | A | 2/1990 | Veneruso | |
| 5,173,022 | A | 12/1992 | Sango | |
| 5,176,164 | A | 1/1993 | Boyle | |
| 5,554,897 | A | 9/1996 | Martin et al. | |
| 5,662,167 | A | 9/1997 | Patterson et al. | |
| 6,364,013 | B1 | 4/2002 | Watson et al. | |
| 6,494,267 | B2 | 12/2002 | Allen | |
| 6,598,675 | B2 | 7/2003 | Bussear et al. | |
| 6,668,925 | B2 | 12/2003 | Shaw et al. | |
| 6,691,782 | B2 * | 2/2004 | Vandevier | 166/265 |
| 6,768,700 | B2 | 7/2004 | Veneruso et al. | |
| 7,073,594 | B2 | 7/2006 | Stegemeier et al. | |
| 7,188,669 | B2 | 3/2007 | Bullock et al. | |
| 7,228,914 | B2 * | 6/2007 | Chavers et al. | 166/386 |
| 7,311,152 | B2 | 12/2007 | Howard et al. | |
| 7,487,838 | B2 | 2/2009 | Knight et al. | |
| 7,635,030 | B2 | 12/2009 | Knight et al. | |
| 7,677,320 | B2 | 3/2010 | Shaw et al. | |

(Continued)

FOREIGN PATENT DOCUMENTS

GB 2467402 A 8/2010

OTHER PUBLICATIONS

Unknown, "Expro's wireless safety valve system provides alternative to workovers /Drilling Contractor", May 2010, pp. 1-2, Drilling Contractor Magazine.

(Continued)

*Primary Examiner* — Daniel P Stephenson
*Assistant Examiner* — Michael Wills, III
(74) *Attorney, Agent, or Firm* — Bracewell & Giuliani LLP

(57) ABSTRACT

A method and apparatus for reducing erosion and friction losses in a wellbore using a power cabled deployed electric submersible pump (ESP). The apparatus can include an ESP disposed within production tubing, wherein a portion of the production tubing surrounding the ESP contains fluid openings that are operable to allow produced fluids to flow outward, thereby increasing the available volume for the produced fluids. The increased volume results in lower fluid velocities of the produced fluid, which advantageously reduces erosion and friction loss.

27 Claims, 1 Drawing Sheet

(56) References Cited

U.S. PATENT DOCUMENTS

| | | | | |
|---|---|---|---|---|
| 7,703,508 | B2 | 4/2010 | Orban | |
| 7,806,186 | B2 * | 10/2010 | Brown et al. | 166/335 |
| 2002/0050361 | A1 | 5/2002 | Shaw et al. | |
| 2005/0016735 | A1 * | 1/2005 | Ireland et al. | 166/352 |
| 2006/0196660 | A1 | 9/2006 | Patel | |
| 2010/0025045 | A1 | 2/2010 | Lake et al. | |
| 2010/0319926 | A1 * | 12/2010 | Reid | 166/372 |
| 2011/0005772 | A1 * | 1/2011 | Ceccarelli et al. | 166/372 |
| 2012/0138308 | A1 * | 6/2012 | Noui-Mehidi et al. | 166/369 |

OTHER PUBLICATIONS

Al-Amri, Khalifah M., "Case History—World's First Slim Open Hole Smart MRC Wells", SPE International, SPE 117050, Mar. 2009, pp. 1-6, Society of Petroleum Engineers.

Robison, Clark E., "Monobore Completions for Slim-Hole Wells", SPE 29217, Jun. 1994, pp. 794-799, Society of Petroleum Engineers.

Howlett, P.D. et al., "Case Study of New Slender Well Construction Technology", SPE International, SPE 102580, Sep. 2006, pp. 1-12, Society of Petroleum Engineers.

Mubarak, Hisham A., et al., "ESP Failures/Analysis/Solutions in Divided Zone—Case Study", SPE International, SPE 81488, Apr. 2003, pp. 1-6, Society of Petroleum Engineers.

Lea, J.F., et al., "Artificial Lift for Slim Holes", SPE International, SPE 63042, Oct. 2000, pp. 1-9, Society of Petroleum Engineers.

Albright, Jim, et al., "Road Map for a 5000-Ft Microborehole", pp. 1-38.

PCT Int'l Search Report and The Written Opinion dated Jul. 25, 2013; Int'l Application No. PCT/US2012/025810; Int'l Filing Date: Feb. 20, 2012.

* cited by examiner

APPARATUS AND METHODS FOR WELL COMPLETION DESIGN TO AVOID EROSION AND HIGH FRICTION LOSS FOR POWER CABLE DEPLOYED ELECTRIC SUBMERSIBLE PUMP SYSTEMS

TECHNICAL FIELD OF THE INVENTION

Embodiments of the present invention relates to a method and apparatus for avoiding erosion and high friction loss for power cable deployed electric submersible pump (ESP) systems.

BACKGROUND OF THE INVENTION

For certain production wells, artificial lift systems can become necessary when the natural pressure within the underground reservoir is no longer adequate to naturally push produced fluids to the surface. Electric submersible pumps (ESPs) are often used in these situations. Electric power is transmitted from the surface via an umbilical power cable to the downhole ESP. Conventionally, ESPs were deployed at the end of production tubing, with the power cable installed outside the production tubing. However, electrical failures were often associated with this type of setup, and anytime there was an electrical failure, a rig had to be brought in to pull out the production tubing and the ESP.

In an effort to overcome this problem, alternative ESP systems were developed. One such system is a power cable deployed ESP system. In this system, the power cable is used to transmit power, as well as to support the ESP itself. In this alternate setup, both the power cable and the ESP are installed inside the production tubing.

In order to improve overall safety for a power cable deployed ESP system, well control can employ a deep set surface controlled subsurface safety valve (SCSSV). The SCSSV is installed in the production tubing below the ESP. The SCSSV is designed to be fail-safe, so that the wellbore is isolated in the event of any system failure or damage to the surface production-control facilities. An example of a prior art setup is shown in FIG. 1.

In FIG. 1, production tubing 40 is disposed within casing 20. ESP 90 is supported by power cable 100, as well as production tubing 40 via isolation member 120. Casing 20 has perforations 22 in a producing region 30 of an underground reservoir. Produced fluids enter casing 20 through perforations 22. The produced fluids then travel through the safety valve 80 into an inner volume 105 of production tubing 40, and flow through a narrow gap between ESP 90 and production tubing 40. The produced fluid then enters ESP 90 via intake slots 97, travels through medial pump body portion 98, and exits ESP 90 above isolation member 120 via discharge slots 111. The produced fluid is now back within production tubing 40 (at a point above isolation member 120), where it can be pumped to the surface. Lower packer 50 prevents produced fluids from traveling up the annular region formed between production tubing 40 and casing 20.

In these types of setups, the fluid velocity of the production fluids can get quite high due to the narrow gap between the production tubing and the ESP. In typical installations, the narrow gap can range from 0.079 inch to 0.225 inch, depending on the size of the production tubing and chosen ESP. For a typical target rate of 6,000 barrels per day (bpd) production using production tubing of 4½ inch, the fluid velocity of the produced fluid coming through this gap can be 70 ft/s. For 5½ inch tubing, the velocity can still reach 40 ft/s. However, at fluid velocities in this range, the ESP system can fail quickly due to erosion. Additionally, at high velocities such as these, the frictional losses are quite significant. Overcoming frictional losses is usually achieved using longer motors and longer pumps; however, doing this increases the capital costs. Additionally, longer equipment increases installation difficulties, particularly for live well deployment with a surface lubricator. As such, ESP systems are typically only operated at 1,000 to 2,000 bpd.

Therefore, it would be advantageous to provide an ESP system that did not suffer from erosion or high friction losses at production rates higher than 2,000 bpd.

SUMMARY OF THE INVENTION

The present invention is directed to a method and apparatus that provides one or more of these benefits. In one embodiment, the invention provides for an ESP assembly for use in a wellbore, wherein the ESP assembly includes a pump and a tubing section adapted for insertion within casing of the wellbore thereby defining an annulus between the tubing section and the casing. The tubing section circumferentially surrounds a portion of the pump. The tubing section includes fluid openings that are operable to allow fluid from the wellbore to flow radially outward, thereby occupying a greater volume, and therein reducing the bulk fluid velocity of the fluid. The pump can include a fluid inlet, a seal section, a pump discharge and a pump motor coupled to the pump.

In one embodiment, the tubing section can be integral within a string of production tubing that is adapted for insertion into the wellbore. In another embodiment, the ESP assembly further includes a safety valve positioned at a lower end of the tubing section. The safety valve has an open and closed position, and the safety valve is positioned such that fluid from the wellbore enters the tubing section through the safety valve when the safety valve is in an open position. In another embodiment, the ESP assembly can further include a safety valve control line that is in communication with the safety valve.

In one embodiment, the fluid openings are selected from the group consisting of slots, holes, perforations, and combinations thereof. Those of ordinary skill in the art will recognize that the fluid openings can be of any size, shape, and pattern so long as the integrity of the production tubing is maintained. In one embodiment, the fluid openings are perforations having diameters in the range of ¼ inch to ½ inch. In another embodiment, the ESP assembly can include a lower packer and an upper packer, wherein the lower packer is connected to the casing and the production tubing, the lower packer being positioned proximate the lower end of the production tubing, the lower packer being operable to support the positioning of the production tubing within the casing. The upper packer is connected to the casing and the production tubing, and the upper packer is positioned at a point above the lower packer thereby forming a first interstitial space in the annulus between the upper packer and the lower packer. A second interstitial space is also formed in the annulus between the upper packer and the surface.

In another embodiment, the ESP assembly for use in a wellbore can include casing, production tubing, the lower packer, the upper packer, the safety valve, and the safety valve control line in communication with the safety valve. The casing is positioned within a hydrocarbon wellbore and is in fluid communication with a producing region of a reservoir such that produced fluid can enter the casing. The production tubing is positioned within the casing to provide a pathway for produced fluids dispersed from the hydrocarbon well. The production tubing has a diameter that is less than the diameter of the casing such that an annulus is formed between an outer wall of the production tubing and an inner wall of the casing, wherein the production tubing has a lower end that is distal from the surface. The lower packer is connected to the casing and the production tubing and is positioned proximate the lower end of the production tubing. The lower packer is operable to support the positioning of the production tubing within the casing. The upper packer is connected to the casing and the production tubing. The upper packer is positioned at a point above the lower packer, thereby forming the first interstitial space in the annulus between the upper packer and the lower packer. The second interstitial space is formed in the annulus between the upper packer and the surface. The safety valve is positioned on an inner wall of the production tubing proximate the lower packer, and the safety valve has an open position and a closed position. The first interstitial space is in fluid communication with the production tubing, such that the assembly is operable to allow produced fluid from the producing region of the reservoir to flow from the production tubing into the first interstitial space. This causes the fluid velocity of the produced fluid to be less than the fluid velocity of the produced fluid if the first interstitial space was not in fluid communication with the production tubing.

In another embodiment, the ESP assembly can also include an absence of perforations in the casing in areas other than proximate the producing region of the reservoir. In another embodiment, the casing does not allow produced fluids to reenter the reservoir. In another embodiment, the second interstitial space is not in fluid communication with the production tubing.

In another embodiment, the assembly is operable to house an ESP within the production tubing. The ESP can include a pump intake, a pump discharge, a medial pump body portion, an isolation member, a motor, and a seal section. The pump intake can be positioned above the safety valve so that the produced fluids enter the pump intake. The pump discharge can be positioned above the upper packer and within the production tubing so that the produced fluids are discharged within inner walls of the production tubing and sent to the surface. The medial pump body portion can extend between the pump intake and the pump discharge and can also provide a pathway through which the produced fluids flow from the pump intake to the pump discharge. The isolation member can be positioned at an upper portion of the ESP, and the isolation member is operable to isolate the pump intake from the pump discharge. The motor is connected to the ESP and provides power to the ESP. The seal section can be connected between the motor and a distal end portion of the pump intake, with the seal section being operable to prevent produced fluids from entering the motor. In another embodiment, the second interstitial space is not in fluid communication with the ESP.

In another embodiment, the portion of the tubing between the upper packer and safety valve can include fluid openings for allowing the produced fluids to enter the first interstitial space. In another embodiment, the perforations fluid openings can have diameters in the range from ¼ inch to ½ inch. In another embodiment, the casing can extend through the producing region of the reservoir. In one embodiment, the fluid velocity of the produced fluid can be maintained below 20 fps when producing more than 2,000 bpd. In another embodiment, the fluid velocity of the produced fluid is maintained between 10 to 20 fps when producing up to 6,000 bpd. In another embodiment, the fluid velocity of the produced fluid is maintained below 20 fps when producing up to 32,000 bpd for 4½ inch tubing (7 inch casing). In another embodiment, the fluid velocity of the produced fluid is maintained below 20 fps when producing up to 45,000 bpd for 7 inch tubing (9⅝ inch casing).

Embodiments of the present invention also include a method for enhanced well control of high fluid velocity wells. In one embodiment, the method can include providing any ESP assembly discussed herein, inserting the ESP assembly into a wellbore that is in fluid communication with an underground hydrocarbon reservoir, and flowing fluid from the underground hydrocarbon reservoir through the fluid openings of the tubing string and radially outward, such that the fluid occupies a greater volume of space, thereby lowering the fluid velocity of the fluid.

In another embodiment, the invention can include a method for enhanced well control for high fluid velocity wells can include the steps of positioning casing into a bore of a hydrocarbon well, positioning production tubing at least partially within the casing, connecting a lower packer to the casing and the production tubing, connecting an upper packer to the casing and the production tubing, positioning a safety valve on an inner wall of the production tubing proximate the lower packer, communicating with the safety valve, and allowing produced fluids to flow from the reservoir through the opening of the safety valve to the production tubing and the first interstitial space, such that the fluid velocity of the produced fluid is less than the fluid velocity of the produced fluid if the first interstitial space was not in fluid communication with the production tubing.

In another embodiment, the method can also include the step of operating the ESP so that the produced fluids enter the ESP, flow through the ESP, and discharge from the ESP back into the production tubing above the isolation member and then travel on to the surface. In another embodiment, the second interstitial space is not in fluid communication with the ESP. In another embodiment, the hydrocarbon well is located offshore.

BRIEF DESCRIPTION OF THE DRAWINGS

These and other features, aspects, and advantages of the present invention will become better understood with regard to the following description, claims, and accompanying drawings. It is to be noted, however, that the drawings illustrate only several embodiments of the invention and are therefore not to be considered limiting of the invention's scope as it can admit to other equally effective embodiments.

DETAILED DESCRIPTION

While the invention will be described in connection with several embodiments, it will be understood that it is not intended to limit the invention to those embodiments. On the contrary, it is intended to cover all the alternatives, modifications and equivalents as may be included within the spirit and scope of the invention defined by the appended claims. Like numbers refer to like elements throughout.

Embodiments of the present invention can improve ESP performance in most any reservoir; however, the embodiments are most advantageous in wells that typically experience higher than normal friction losses or erosion damage to an ESP. Pressure losses at or above 50 psi are generally regarded as high friction losses. As will be understood by those skilled in the art, embodiments of the present invention, for example, also can allow produced fluids to more readily flow when pumped by use of an ESP. While the embodiments shown in the figures generally show vertical bores, those of ordinary skill in the art will understand that embodiments of the present invention can also apply to horizontal bores. Therefore, embodiments of the present invention are useful for pumping produced fluids from either a horizontal bore or vertical bore of a hydrocarbon well to the surface.

High fluid velocity can result in premature failure of down hole components such as an ESP due to erosion damage. Accordingly, embodiments of the present invention can enhance well control, for example, by improving production rates and reducing the rate of premature failure of an ESP.

Figure 1:
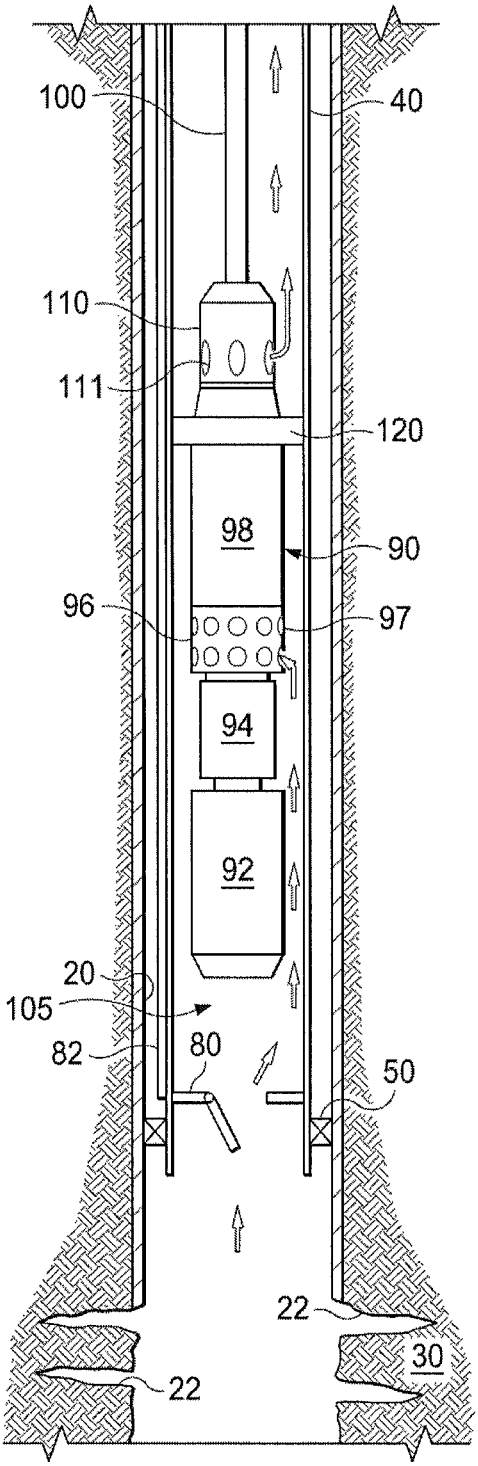
FIG. 1 (PRIOR ART)
FIG. 1 is a front elevational view of an apparatus in accordance with an apparatus known in the prior art.
Figure 2:
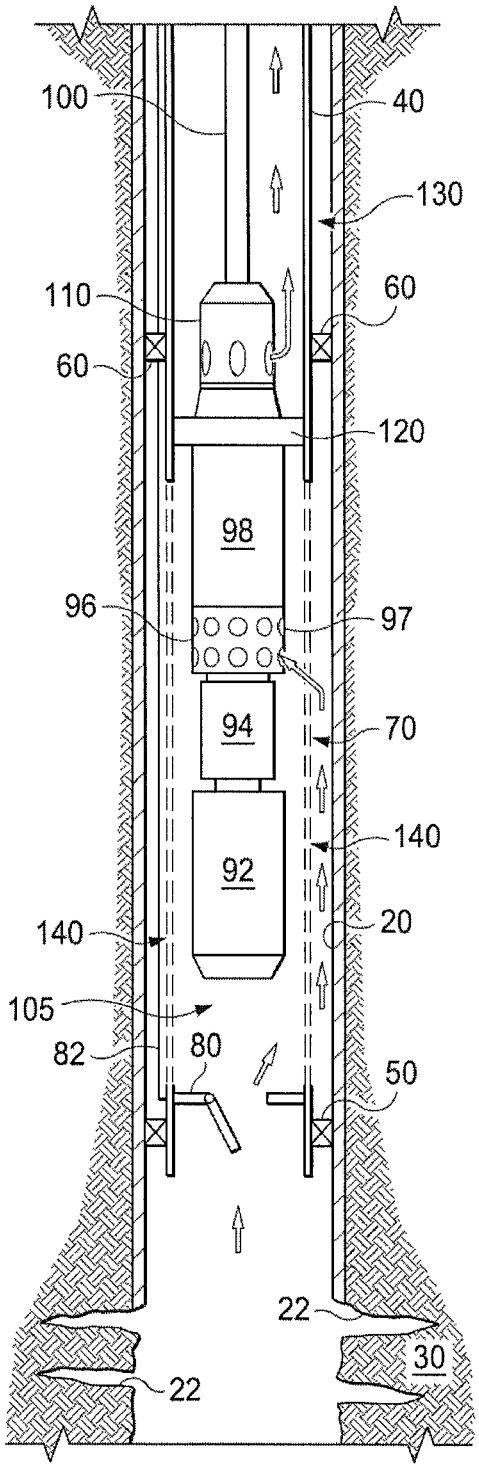
FIG. 2 is a front elevational view of an apparatus in accordance with an embodiment of the present invention.

Now turning to FIG. 2. Embodiments of the present invention include positioning casing 20 within wellbore 10. The bottom of the well can be an open-hole, cased-hole completion, or any other bottom hole completion, as will be understood by those skilled in the art, to be suitable for embodiments of the present invention. For example, an open-hole, top set, or barefoot completion can be made by drilling down producing region 30 and subsequently casing wellbore 10. According to this embodiment, wellbore 10 is drilled through producing region 30 leaving the bottom of wellbore 10 open. Casing 20 in a cased-hole completion, according to another embodiment of the present invention, is run through the producing region 30, and cemented in place. As illustrated in FIG. 2, according to this embodiment, perforations 22 are made in casing 20 to allow produced fluids to fluidly travel from producing region 30 of the underground reservoir to within casing 20 and eventually onward to the surface.

After casing 20 is positioned within wellbore 10, cement is pushed between the outer walls of casing 20 and the inner walls of wellbore 10 to set casing 20 thereto. Casing 20, for example, can prevent the contamination of fresh water zones. Casing 20 can be made out of steel pipe to support wellbore 10, and in accordance the American Petroleum Institute specifications and standards as understood by those skilled in the art.

To further support wellbore 10, and to provide a pathway for produced fluids dispersed from wellbore 10 to the surface, embodiments of the present invention include production tubing 40. Production tubing 40 has an outside diameter that is less than the inside diameter of casing 20. Lower packer 50 is positioned between outer walls of production tubing 40 and inner walls of casing 20 and is also positioned proximate the lower end of production tubing 40. Lower packer 50 is adapted to support the positioning of production tubing 40 within casing 20, as well as also to prevent produced fluids from entering first interstitial space 70 without first passing through safety valve 80 when safety valve 80 is in an open biased position. When safety valve 80 is in a closed biased position, lower packer 50, in conjunction with safety valve 80, prevents produced fluids from entering first interstitial space 70.

As illustrated in FIG. 2, embodiments of the present invention include ESP 90 being operable to pump produced fluids from wellbore 10 and thereby fluidly travel to the surface. In the embodiment shown in FIG. 2, ESP 90 is positioned entirely within production tubing 40, with a portion of ESP 90 extending below isolation member 120 and a portion extending above isolation member 120. The portion of ESP 90 disposed below isolation member 120, e.g., further down hole. can include, for example, motor 92, seal sections 94, pump intake 96, and at least a region of medial pump body portion 98. The outer diameter of ESP 90 has a smaller diameter than the inner diameter of production tubing 40.

During operation, according to certain embodiments of the present invention, motor 92 receives power through power cable 100. In one embodiment, ESP 90 can include one or more centrifugal pumps (not shown) within medial pump body portion 98. The one or more centrifugal pumps suction produced fluids from inner volume 105 within production tubing 40. The produced fluids are suctioned from inner volume 105 through a plurality of intake slots 97, and pumped by the one or more centrifugal pumps to increase the pressure and flow of the produced fluids that entered pump intake 96. The produced fluids are then sent to pump discharge 110 and discharged through a plurality of discharge slots 111 to a proximal region within the inner walls of the production tubing 40 and onward to the surface. The outer areas of pump discharge 110 and pump intake 96 are separated by isolation member 120. During operation, isolation member 120 provides a barrier to allow for a pressure differential to form across isolation member 120 due to the produced fluids being pumped from pump intake 96 to pump discharge 110.

In one embodiment, ESP 90 includes motor 92 to drive one or more centrifugal pumps within medial pump body portion 98. Motor 92, for example, can be the most down hole major component of ESP 90. During operation, motor 92 runs in the range of speed of about 2,500 to 3,500 rev/min. In some embodiments, motors that are operable to run at about 10,000 RPM could be used. Those of ordinary skill in the art will recognize that the speed is related to the exact equipment used. As will be understood by those skilled in the art, during operation, the flow of produced fluids that pass the outer surfaces of the motor also can act as a coolant to reduce heat associated with operation of ESP 90 to thereby assist in preventing ESP 90 from overheating.

Embodiments of ESP 90 further include one or more seal sections 94 to prevent produced fluids from entering within inside surfaces of motor 92. In addition to preventing produced fluids from entering the inside surfaces of motor 92, the one or more seal sections 94 equalizes external bottom hole pressures and internal pressures of the motor 92. Moreover, as will be understood by those skilled in the art, the one or more seal sections 94 allows lubricant associated with motor 92 to thermally expand and contract.

ESP 90 can also include pump intake 96 whereby produced fluids enter ESP 90. Pump intake 96 includes a plurality of intake slots 97 that are preferably evenly spaced in a location where the produced fluids are suctioned therethrough. The plurality of intake slots 97 can be a variety of uniform shapes including, but not limited to, spherical, ellipsoidal, or rectangular as understood by those skilled in the art. Pump intake 96 preferably is connected between a proximal end portion of the one or more seal sections 94 and a distal end portion of medial pump body portion 98 as illustrated in FIG. 2.

Medial pump body portion 98 can include one or more centrifugal pumps to pump the produced fluids that enter ESP 90. The horsepower of the one or more centrifugal pumps ranges from about 75 to 300 during operation. The one or more centrifugal pumps increase the flow rate of the produced fluids entering ESP 90 to artificially lift the produced fluids to the surface. In a preferred embodiment of ESP 90, the one or more centrifugal pumps have a large number of stages, each stage having an impeller and a diffuser. Medial pump body portion 98 extends between pump intake 96 and pump discharge 110 so that produced fluids flow therebetween from pump intake 96 to pump discharge 110.

Embodiments of the present invention can also include isolation member 120 disposed between pump discharge 110 and medial pump body portion 98. According to embodiments of the present invention, isolation member 120 connects to the inner walls of production tubing 40 to support the positioning of ESP 90.

ESP 90 can include pump discharge 110 to discharge the produced fluids for onward transfer within production tubing 40 to the surface. Pump discharge 110, for example in one embodiment, includes a plurality of discharge slots 111 that can be evenly spaced in a location where the produced fluids are discharged to a proximal region within the inner walls of production tubing 40. The plurality of discharge slots 111, as will be understood by those skilled in the art, can be a variety of uniform shapes including, but not limited to, spherical, ellipsoidal, or rectangular. As illustrated by the arrows in FIG. 2, for example, pump discharge 110 is positioned within production tubing 40 so that produced fluids discharge through discharge slots 111 and fluidly travel through production tubing 40 and onward to the surface.

Embodiments of the present invention can include, for example, safety valve 80 being operable to prevent produced fluids from flowing into inner volume 105 of production tubing 40 when safety valve 80 is in the closed position. Safety valve 80 selectively, or in the case of an emergency, assists to prevent produced fluids from dispersing to the surface. Safety valve 80, according to an embodiment of the present invention, is connected to the inner walls of production tubing 40 and is distally disposed from ESP 90 within production tubing 40. In one embodiment, safety valve 80 can be a deep set surface controlled subsurface safety valve (SCSSV). Industry well control policy requires all wells that are in close proximity to people or facilities to be equipped with an SCSSV. Conventionally, the SCSSV is shallow set (e.g. about 200-300 It below the wellhead). However, in embodiments of the present invention, safety valve 80 is deep set (e.g. located below ESP 90).

Embodiments of the present invention also include upper packer 60 and first interstitial space 70. First interstitial space 70 being the annular volume created between casing 20 and production tubing 40, and lower packer 50 and upper packer 60. In one embodiment, a portion of production tubing 40 below isolation member 120 and above safety valve 80 contains fluid openings 140, such that first interstitial space 70 is in fluid communication with inner volume 105 of production tubing 40. The produced fluid can now travel all the way to casing 20, affectively increasing the available volume, which in turn reduces the fluid velocity of the produced fluids.

Upper packer 60 is adapted to prevent produced fluids from flowing in the annular area between the inner walls of casing 20 and the outer walls of production tubing 40 above upper packer 60, hereby defined as second interstitial space 130.

During operation, produced fluids are produced from producing region 30 and flow through perforations 22 to the inner walls of casing 20 distal from safety valve 80. According to an embodiment of the present invention, power and communication are transmitted to safety valve 80 through safety valve control line 82 connected to a proximal end of safety valve 80. In one embodiment, safety valve control line 82 receives power from the surface. In another embodiment (not shown), safety valve control line 82 can receive power directly from the ESP. When safety valve 80 is in the "open" position, produced fluids flow safety valve 80 to inner volume 105 of production tubing 40 before entering first interstitial space 70. When safety valve 80 is in the "closed" position, produced fluids are prevented from traveling to inner volume 105 of production tubing 40 or first interstitial space 70. Safety valve 80, as will be understood by those skilled in the art, preferably is in a fall-back mode so that any interruption or malfunction should result in safety valve 80 being in the closed position.

In another embodiment, safety valve control line 82 can be removed and replaced with a wireless communication device that is operable to communicate with safety valve 80 wirelessly. Moreover, as will be understood by those skilled in the art, embodiments of the present invention can include communicating by hydraulic or pneumatic methods as well.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed.

We claim:

1. An electric submersible pump (ESP) assembly for use in a wellbore, the assembly comprising:

a pump, wherein the pump comprises:

a fluid inlet, a seal section, a pump discharge, and a pump motor coupled to the pump;

a tubing section adapted for insertion within a casing to define an annulus between the tubing section and the casing, the tubing section circumferentially surrounding a portion of the pump, wherein the tubing section comprises fluid openings that are operable to allow produced fluid from the wellbore to flow radially outward and occupy a greater volume than a volume defined by the tubing section alone, thereby reducing a fluid velocity of the produced fluid; and a lower packer and an upper packer, the lower packer being connected to the casing and a production tubing, the lower packer being positioned proximate the lower end of the production tubing, the lower packer being operable to support the positioning of the production tubing within the casing, the upper packer connected to the casing and the production tubing, the upper packer being positioned at a point above the lower packer thereby forming a first interstitial space in the annulus between the upper packer and the lower packer and a second interstitial space in the annulus between the upper packer and the surface.

2. The ESP assembly as claimed in claim 1, wherein the tubing section is integral within a string of production tubing that is adapted for insertion into the wellbore.

3. The ESP assembly as claimed in claim 1, further comprising a safety valve positioned at the lower end of the tubing section, the safety valve having an open and a closed position, wherein the produced fluid from the wellbore enters the tubing section through the safety valve when the safety valve is in an open position.

4. The ESP assembly as claimed in claim 3, further comprising a control line in communication with the safety valve.

5. The ESP assembly as claimed in claim 1, wherein the fluid openings are selected from the group consisting of slots, holes, perforations, and combinations thereof, wherein tubular integrity of the production tubing is not compromised.

6. An electric submersible pump (ESP) assembly for use in a wellbore, the assembly comprising:

a casing positioned within a bore of a hydrocarbon well, the casing being in fluid communication with a producing region of a reservoir such that produced fluid can enter the casing;

a production tubing positioned within the casing to provide a pathway for produced fluids dispersed from the hydrocarbon well, the production tubing having a diameter that is less than the diameter of the casing such that an annulus is formed between an outer wall of the production tubing and an inner wall of the casing, the production tubing having a lower end that is distal from the surface;

a lower packer connected to the casing and the production tubing, the lower packer being positioned proximate the lower end of the production tubing, the lower packer being operable to support the positioning of the production tubing within the casing;

an upper packer connected to the casing and the production tubing, the upper packer being positioned at a point above the lower packer thereby forming a first interstitial space in the annulus between the upper packer and the lower packer and a second interstitial space in the annulus between the upper packer and the surface;

a safety valve positioned on an inner wall of the production tubing proximate the lower packer, the safety valve having an open position and a closed position; and a safety valve control line in communication with the safety valve, wherein the first interstitial space is in fluid communication with the production tubing, such that the assembly is operable to allow produced fluid from the producing region of the reservoir to flow from the production tubing into the first interstitial space, such that a fluid velocity of the produced fluid is less than the fluid velocity of the produced fluid if the first interstitial space was not in fluid communication with the production tubing.

7. The ESP assembly as claimed in claim 6, further comprising an absence of perforations in the casing in areas other than proximate the producing region of the reservoir.

8. The ESP assembly as claimed in claim 6, wherein the casing does not allow produced fluids to reenter the reservoir.

9. The ESP assembly as claimed in claim 6, wherein the second interstitial space is not in fluid communication with the production tubing.

10. The ESP assembly of 6, wherein the assembly is operable to house an ESP within the production tubing, wherein the ESP comprises:

a pump intake positioned above the safety valve so that the produced fluids enter the pump intake;

a pump discharge positioned above the upper packer and within the production tubing so that the produced fluids are discharged within inner walls of the production tubing and to the surface;

a medial pump body portion extending between the pump intake and the pump discharge through which the produced fluids flow from the pump intake to the pump discharge;

an isolation member positioned at an upper portion of the ESP for isolating the pump intake from the pump discharge;

a motor for supplying power to the ESP; and a seal section connected between the motor and a distal end portion of the pump intake, the seal section being operable to prevent produced fluids from entering the motor.

11. The ESP assembly as claimed in claim 10, wherein the second interstitial space is not in fluid communication with the ESP.

12. The ESP assembly as claimed in claim 6, wherein the portion of the tubing between the upper packer and safety valve comprises fluid openings for allowing the produced fluids to enter the first interstitial space.

13. The ESP assembly as claimed in claim 12, wherein the fluid openings are selected from the group consisting of slots, holes, perforations, and combinations thereof, wherein tubular integrity of the production tubing is not compromised.

14. The ESP assembly as claimed in claim 6, wherein the casing extends through the producing region of the reservoir.

15. The ESP assembly as claimed in claim 6, wherein the fluid velocity of the produced fluid is not greater than 20 fps.

16. A method for enhanced well control for high fluid velocity wells, the method comprising the steps of:

providing an ESP assembly, the ESP assembly selected from the group consisting of the ESP assembly as claimed in Claim 1 or Claim 6;

inserting the ESP assembly into a wellbore, wherein the wellbore is in fluid communication with an underground hydrocarbon reservoir; and flowing fluid from the underground hydrocarbon reservoir through the fluid openings of the tubing string and radially outward, such that the fluid occupies a greater volume of space than a volume defined by the tubing section alone, the greater volume of space defined by both the tubing section and an annulus between the tubing section and the casing, thereby lowering the fluid velocity of the fluid.

17. A method for enhanced well control for high fluid velocity wells, the method comprising the steps of:

positioning casing into a bore of a hydrocarbon well, the bore extending from a surface and having an inner diameter, wherein the casing is in fluid communication with a producing region of a reservoir such that produced fluids can enter the casing;

positioning production tubing at least partially within the casing to provide a pathway for produced fluids, the production tubing having a diameter that is less than the diameter of the casing such that an annulus is formed between an outer wall of the production tubing and an inner wall of the casing, the production tubing having a lower end that is distal from the surface;

connecting a lower packer to the casing and the production tubing, the lower packer being positioned proximate the lower end of the production tubing, the lower packer being operable to support the positioning of the production tubing within the casing;

connecting an upper packer to the casing and the production tubing, the upper packer being positioned at a point above the lower packer thereby forming a first interstitial space in the annulus between the upper packer and the lower packer;

positioning a safety valve on an inner wall of the production tubing proximate the lower packer, the safety valve having a bias between an open position and a closed position, the safety valve creating an opening when in the open position;

communicating with the safety valve using a safety valve control line to control the bias of the safety valve; and allowing produced fluids to flow from the reservoir through the opening of the safety valve to the production tubing and the first interstitial space, such that the fluid velocity of the produced fluid is less than the fluid velocity of the produced fluid if the first interstitial space was not in fluid communication with the production tubing.

18. The method as claimed in claim 17, further comprising the step of operating an electric submersible pump (ESP) so that the produced fluids enter the ESP, flow through the ESP, and discharge from the ESP to an inner volume of the production tubing and to the surface.

19. The method as claimed in claim 18, wherein the second interstitial space is not in fluid communication with the ESP.

20. The method as claimed in claim 17, wherein the portion of the tubing between the upper packer and safety valve comprises fluid.

21. The method as claimed in claim 20, wherein fluid openings provided in the outer wall of the production tubing establish fluid communication between the production tubing and the first interstitial space, and wherein the fluid openings are selected from the group consisting of slots, holes, perforations, and combinations thereof, wherein tubular integrity of the production tubing is not compromised.

22. The method as claimed in claim 17, wherein the casing extends through the producing region of the reservoir.

23. The method as claimed in claim 17, wherein the fluid velocity of the produced fluid is not greater than 20 fps.

24. The method as claimed in claim 17, wherein the casing further comprises an absence of perforations in areas other than proximate the producing region of the reservoir.

25. The method as claimed in claim 17, wherein the casing is operable to prevent produced fluids from reentering the reservoir.

26. The method as claimed in claim 17, wherein the second interstitial space is not in fluid communication with the production tubing.

27. The method as claimed in claim 17, wherein the hydrocarbon well is located offshore.

* * * * *